United States Patent [19]

Patel et al.

[11] 4,058,453

[45] Nov. 15, 1977

[54] DEMULSIFICATION OF OIL EMULSIONS WITH A MIXTURE OF POLYMERS AND ALKALINE EARTH METAL HALIDE

[75] Inventors: Mahendra S. Patel; Aleksy Sacuta, both of Edmonton, Canada

[73] Assignee: Texaco Exploration Canada Ltd., Calgary, Canada

[21] Appl. No.: 713,456

[22] Filed: Aug. 11, 1976

[51] Int. Cl.[2] ..... C10G 33/04

[52] U.S. Cl. ..... 208/188; 252/329

[58] Field of Search ..... 208/188, 187; 252/328, 252/331, 327, 329

[56] References Cited

U.S. PATENT DOCUMENTS

| | | | |
|---|---|---|---|
| 1,515,093 | 11/1924 | Crites et al. | 208/188 |
| 2,964,478 | 12/1960 | Monson | 252/331 |
| 3,245,466 | 4/1966 | Hitzman | 252/327 |
| 3,441,499 | 4/1969 | Francis, Jr. et al. | 208/187 |

*Primary Examiner*—George Crasanakis

*Attorney, Agent, or Firm*—Thomas H. Whaley; Carl G. Ries; Henry W. Archer

[57] ABSTRACT

A process for recovering oil from either water-bituminous petroleum emulsions or from crude petroleum emulsions having a pH of 10 or less by adding thereto an optimum amount of non-ionic, water soluble polyethylene oxide polymers at a pH of 10 or less, and separating the oil from water. To resolve bituminous petroleum emulsions, the process is carried out at between 150° F and 210° F and a diluent is added to reduce the petroleum viscosity. The minimum effective concentration of the polymers used decreases as their molecular weight increases.

In a modification of the process, an effective amount of an alkaline earth metal halide such as calcium chloride is added to improve coagulation and separation of any clay present.

9 Claims, No Drawings

DEMULSIFICATION OF OIL EMULSIONS WITH A MIXTURE OF POLYMERS AND ALKALINE EARTH METAL HALIDE

BACKGROUND OF THE INVENTION

1. Field of the Invention

This invention is concerned with the resolution of water-bituminous emulsions and conventional petroleum emulsions by treatment with polyethylene oxide resins of optimum molecular weight at a controlled pH range. The invention is also concerned with the separation of water from bitumen which has been brought to the surface in the form of water-in-oil or oil-in-water emulsions by an in situ recovery process.

2. STATEMENT OF THE PRIOR ART

Numerous hot water extraction methods exist for separating crude oil from bituminous sands (tar sands, oil sands and the like) which involve mixing such sands with hot or cold water and separating the sand from the resulting emulsions.

The technical difficulty encountered with emulsions produced by an situ operations is that the liquid mixture is a highly stabilized emulsion which is difficult to break with standard treating chemicals.

The attempts made in the prior art to break emulsions resulting from hot water extraction processes are represented, inter alia, by the techniques described in U.S. Pat. Nos. 3,808,120; 3,607,721, and 3,487,003.

U.S. Pat. No. 3,808,120 describes a method for separating at least water and solids from the froth produced in a hot water process for separating bitumen from tar sands by treating the froth in at least one cyclone zone after which it is treated in at least two centrifuging zones.

In U.S. Pat. No. 3,606,721, a process for the removal of solids and emulsified water from a bituminous emulsion is disclosed which comprises diluting the emulsion with a hydrocarbon diluent; maintaining the resulting mixture in a settling zone, removing the emulsion when substantially free of solids and emulsified water from the top of the settling zone, withdrawing settled sludge from the bottom of the settling zone and centrifuging the withdrawn sludge to separate bitmen and diluent from the settled solids and the emulsified water.

U.S. Pat. No. 3,487,003 describes a method for reducing the solids content of an effluent discharge from a hot water process for separating oil from bituminous sands by adding a flocculating agent which may be organic inorganic or even a polyalkylene oxide of undisclosed molecular weight to this effluent; adjusting the pH of the effluent to less than 7.5 or more than 9 to effect flocculation of at least a portion of the solids therein; centrifuging the effluent now containing flocculated solids recovering the effluent discharge substantially reduced in solids content. This method treats not an oil-in-water emulsion but rather an effluent comprised of the effluent from the sand tailings layer and the middlings layer. Further, there is no appreciation therein of the necessity for maintaining the temperature within a given range during treatment with the flocculating agent.

Also generally known in the art is the concept of adding certain chemicals such as organic sequestering agents and organic flocculating agents to petroleum and other emulsions.

The cost of such chemicals amounting to around $1.00 to $1.30 per barrel of bitumen coupled with other operating and capital equipment costs precludes the obtaining of a final product which is economically equivalent to the cost of conventionally produced crude oil.

SUMMARY OF THE INVENTION

The main object of this invention is to achieve functional demulsification of emulsions at a minimal cost.

This object is attained by the present invention which resides in the concept of demulsifying emulsions by adding thereto at a pH of 10 or less from 10 to 60 parts per million of non-ionic water-soluble polyethylene oxide resins having a molecular weight in the range of 100,000 to 7,000,000 thereby causing the oil to separate from water and any clays present. The ethylene oxide polymers remove substantially all the clays from the oil and deposit them in the water phase.

In another aspect of the invention, there is achieved the demulsification of oil-water emulsions recovered by the treatment of bituminous sands.

In a further aspect of the invention, a bituminous petroleum emulsion is treated with the aforementioned resins; diluted with a liquid hydrocarbon diluent; and centrifuged under carefully controlled feed and water recycle rates.

Other aspects of this invention will be apparent to those skilled in the art from a reading of this disclosure and of the appended claims.

DETAILED DESCRIPTION OF THE INVENTION

The process of the invention can be used to treat oil-bearing fluids derived from bituminous sands and conventional crude petroleum emulsion by various methods. In one such method, steam is injected in the sands formation through a center well in a multi-well pattern and the fluids are produced in the adjoining wells. The produced fluids are stable dilute oil-in-water emulsions containing an average of 10% oil with variations in oil phase concentrations from 8 to 25%.

The produced fluids can be treated in a conventional horizontal treater operated at about 250° F and about 20 psig pressure to separate the oil from the water phase. In the present process, to the resulting oil-in-water emulsion is added from about 10 to about 60 parts per million of an ethylene oxide polymer having a molecular weight in the range of 100,000 to 7,000,000. Suitable polymers are those marketed by Union Carbide Corporation under the trademark name of "Polyox". These resins are high polymers with the structure $(O\text{-}CH_2CH_2)_n$ with the degree of polymerization "$n$" ranging from 200 to about 100,000 giving a molecular weight range of 100,000 to about 7 million. Best performance defined as the obtaining of separated oil containing less than 3 percent of water and separated water containing less than 0.5 percent oil is achieved when the temperature of the treated material is in the range of 150°–210° F or below temperatures at which the resin becomes water insoluble. In the practice of the invention, produced fluid from a well or other source is flowed into a heat exchanger to bring it within the desired temperature range and then into a treating vessel. The polymers and from 0 to 50 percent of a hydrocarbon diluent such as toluene, diesel oil, fuel oil, kerosene, etc., are added and mixed with the bitumen-water emulsions.

In the process of the invention, the system is maintained at a pH of 10 or less by the addition of mineral acid. A suitable pH range is 4 to 10.

While not wishing to be bound by any specific theory, the mechanism underlying operation of the subject resins as demulsifying agents for produced fluids is believed to be as follows. The produced fluid emulsion consists of water as the continuous phase and bitumen surrounded by fine clays as the dispersed phase. It is the presence of the fine clays which are more likely held to the bitumen droplets by a static charge that results in the formation of a light bitumen-water emulsion. The subject resins exhibit a stronger attraction for the clays and hence remove clay surrounding the bitumen droplets thus leaving an emulsion which will coalesce and separate naturally. Further the removal of the clays leaves the emulsified bitument accessible to the diluting action of the diluent, a condition which favors reasonable separation times.

With a view to more fully describing the present process, the following examples are given in a non-limiting sense.

EXAMPLE 1

The sample used consisted of production fluids from wells which are essentially all crude oil in water (*o/w*) type, highly clay stabilized dilute emulsions. The oil phase concentrations of the fluids varied between 8 and 24 (*v/v*) and had a pH of 7.2 – 7.9. The additive used was Polyox-FRA — A high molecular weight polymer of ethylene oxide (molecular weight 7,000,000). (Product of Union Carbide Corporation).

An aqueous solution (0.2% *w/v*) of "Polyox" was used for evaluation purposes. The resin (0.2g) was dissolved in water (100 ml) by first dispersing it in boiling water. Gelling of the solution should be avoided while dissolving the resin.

The effect of the chemical agent on the emulsions was evaluated using a bottle-test procedure. The reagents were added to the 16-ounce wide mouth glass jars equipped with "Bakelike" screw caps in the order given below, and were mixed on a wrist-action mechanical shaker for five minutes. The jars were then placed in a gravity oven maintained at 70° C±2° C.

Formation of interface with time was observed over a period of 24 hours or longer.

The materials were added in this order:

1. Diluent (Toluene or Diesel)
2. Production Fluid
3. Chemical Agent

In a typical test, 10 ml of 0.2% aqueous solution (66 ppm of fluid bases) of Polyox-FRA agent was added to 300 ml of production fluid (16% oil cut) containing 34 ml of toluene as diluent. The contents of the jar were mixed for five minutes and then placed in an oven for observation. The volume of water separated was determined by aligning a calibrated 16-ounce jar with the interface of a sample jar.

Several evaluation tests were performed using Polyox-FRA agent on individual as well as combined fluid samples from wells.

Other test results indicated that Polyox-FRA consistently produced demulsification of production fluids at dosages down to 10 ppm with best results at 66 ppm. In all these tests maximum water separation and interface formation occurred within less than 12 hours.

The effect of Polyox-FRA agent on the production fluids was also tested at high fluid temperatures (90°–95° C) using a magnetic stirrer and hot plate arrangement.

EXAMPLE 2

A sample of water-in-oil type emulsion (about 30% oil cut) from the Boundary Lake formation was treated with Polyox-WSR-301 (molecular weight about 4,000,000) at a concentration of 10 ppm (relative to total fluid). The treated sample was demulsified upon standing in an oven at 70° C for less than 24 hours. The resulting oil cut contained no water (Dean and Stark Method) and the liberated water was transparent and colorless. A controlled sample (no chemical added) exhibited no demulsification under identical conditions.

In a modification of the invention, an effective amount ranging from 0 to 20,000, usually 100 to 2,000, parts per million of emulsion, of cation as may be available from an alkaline earth metal halide such as calcium chloride, is added to improve coagulation and separation of the clay. The preferred amount depends on the temperatures, type of clay present, the pH of the system, type of cation added, and the existing concentration of cations. Preferably such addition is effected by adding the halide to the emulsion in the form of an aqueous solution so as to further dilute the emulsion. In this modification of the process, the surface active effect of the polyethylene oxide resins improves the separation of the oil from the clay when the halide begins to coagulate the clay. This modification of the invention is illustrated by the following examples.

EXAMPLE 3

Clay enriched middlings containing 0.03 grams per 100 grams of polyethylene oxide resin per 100 grams of middlings were diluted by the addition of water containing 750 ppm of $CaCl_2$. Air was admitted in the vessel and after aeration the bottoms were centrifuged. It was observed that the precipitate at the bottom of the centrifuge tube was layered. It appeared that sand grains were at the bottom followed by darkened clay and on top was a dark colored material which appeared to be principally bitumen. An analysis was made on the top layer after drying in an oven at 85° C. The top layer contained 47.6% bitumen, dry basis.

EXAMPLE 4

Another test was run using 0.01 gm polyethylene oxide in 300 ml of diluted clay-bitumen simulated middlings. 100 ml of middlings were used. A blend of 100 ml middlings + 0.01 gm "polyox" was shaken up then diluted with 200 ml water, shaken up, and finally 0.15 gm of $CaCl_2$ was added as a 5% solution. This was shaken and allowed to settle. The mixture broke into 3 layers. A heavy sediment on the bottom, a clear middle layer of water and a heavy froth on top. The froth was skimmed off, allowed to dry in an oven at 85° C and an analysis was carried out. The pH of the aqueous system was 10.2. The bitumen content of the top layer of froth was 30.9%.

It is to be understood that the foregoing specific examples are presented by way of illustration and explanation only and that the invention is not limited by the details of such examples.

The foregoing is believed to so disclose the present invention that those skilled in the art to which it appertains can, by applying thereto current knowledge, readily modify it for various applications. Therefore, such modifications are intended to fall within the range of equivalence of the appended claims.

What is claimed is:

1. A process for recovering oil from oil-in-water and water-in-oil emulsions wherein said emulsions contain clay tending to stabilize said emulsions, said process comprising in combination demulsifying said emulsions by adding thereto from 10 to 60 parts per million of non-ionic, water-soluble, polyethylene oxide polymers having a molecular weight in the range of 100,000 to 7,000,000, together with 100 to 20,000 parts per million of an alkaline earth metal halide in an aqueous solution and separating said oil from said water and said clay.

2. The process of claim 1, wherein said emulsions are the fluids produced by an in-situ recovery operation.

3. The process of claim 1 wherein said oil is present in an oil-in-water emulsion.

4. The process of claim 3, wherein said oil originates from bituminous sand.

5. The process of claim 1, further including the steps of diluting said emulsion after the addition of said polymers and said halide with from 30 to 50 volume percent of a hydrocarbon diluent, maintaining the temperature of the resulting mixture between 150° and 210° F; and centrifuging said mixture to separate said oil from said water and said clay.

6. The process of claim 5, wherein sid diluent is diesel oil or toluene.

7. The process of claim 1, carried out at a pH not above 10.

8. The process of claim 1, wherein said polymer has a molecular weight of around 4,000,000.

9. The process of claim 1, wherein said halide is calcium chloride.

* * * * *